US005337767A

United States Patent [19]

Ernst et al.

[11] Patent Number: 5,337,767

[45] Date of Patent: Aug. 16, 1994

[54] APPARATUS AND METHOD FOR CLEANING THE SURFACE OF A WEB

[75] Inventors: Gerard W. Ernst, Rochester; Gregory P. Guyette, Macedon, both of N.Y.

[73] Assignee: Eastman Kodak Company, Rochester, N.Y.

[21] Appl. No.: 993,346

[22] Filed: Dec. 18, 1992

[51] Int. Cl.[5] ..... B08B 3/04

[52] U.S. Cl. ..... 134/104.1; 134/144; 118/203

[58] Field of Search ..... 15/104.002; 134/104.1, 134/144; 118/203

[56] References Cited

U.S. PATENT DOCUMENTS

| | | | |
|---|---|---|---|
| 2,937,390 | 5/1960 | Bolton et al. | 15/3 |
| 3,861,861 | 1/1975 | Thettu | 432/59 |
| 3,877,371 | 4/1975 | Jaffa | 15/104.002 |
| 4,982,469 | 1/1991 | Nishiwaki | 15/3 |
| 5,251,348 | 10/1993 | Corrado et al. | 15/256.53 |

FOREIGN PATENT DOCUMENTS

| | | | |
|---|---|---|---|
| 2457300 | 6/1975 | Fed. Rep. of Germany | 15/104.002 |
| 61-187981 | 8/1986 | Japan | 15/104.003 |
| 62-180786 | 8/1987 | Japan | 15/104.003 |

*Primary Examiner*—Frankie L. Stinson
*Attorney, Agent, or Firm*—Clyde E. Baily

[57] ABSTRACT

A web cleaning apparatus and method for cleaning the surface of a web (22), for example a photographic film. The apparatus has a rotatable particle transfer roller (10) for removing particulate contamination from the web and a rotatable renewal roller (30) having a cleaning surface (36) for contacting and cleaning the particle transfer roller. Wiping contact is established between the particle transfer roller and the renewal roller to effectuate cleaning of the transfer roller. An absorbent cleaning member (46) is positioned in a cleaning fluid reservoir (32) for wetting and cleaning the cleaning surface of the renewal roller.

10 Claims, 3 Drawing Sheets

APPARATUS AND METHOD FOR CLEANING THE SURFACE OF A WEB

FIELD OF INVENTION

The present invention is directed to an apparatus and method for transferring particle contamination from a web to a particle transfer roller. More particularly, the invention is directed toward an apparatus and method for renewing the particle transfer roller.

BACKGROUND OF THE INVENTION

Removal of particulate contamination from the surface of a web is important in many applications, such as cleaning exposed photographic film used in film projection systems, or in the manufacturing of photographic film and the like. Systems for removing particulate contamination from a web surface are well known. For example, air knives and suction cleaning systems are used for this purpose. Particle transfer rollers have proven to be particularly effective in removing particles from web surfaces. A particle transfer roller typically has an adhesive or tacky surface to which particles from the web surface adhere upon contact. A problem with particle transfer rollers, however, is that the cleaning effectiveness of the roller deteriorates as the particles accumulate on the roller surface.

U.S. Pat. No. 4,982,469 describes a sheet surface cleaning apparatus comprising a rotatable dust removing roll having a sticky surface. The apparatus includes a roll cleaning device formed of a flexible porous cleaning pad contactable with the dust removing roll for cleaning the sticky surface. A disadvantage of this device is that the effectiveness of the cleaning pad can deteriorate as particles accumulate on its surface, requiring frequent maintenance shutdown of the apparatus for replacement of the cleaning pad.

U.S. Pat. No. 3,861,861 describes a cleaning apparatus comprising a conformable roll having a sleeve for electrostatically cleaning paper and toner contaminants from a copier fuser roll. A wiper pad of wool or dacron is provided for removing the contaminants from the sleeve. A disadvantage is that no means is provided for cleaning the contaminants that build up on the wiper pad itself, reducing the effective cleaning life of the wiper pad and its cleaning efficiency.

U.S. Pat. No. 2,937,390 describes an apparatus for renewing the tacky surface of a gelatin particle transfer roller comprising a trough containing a plasticizer that is wicked onto the surface of the roller. A disadvantage of the apparatus is that it is not a suitable system for renewing a nongelatin particle transfer roller.

It is an object of the invention to provide a particle transfer roller apparatus and method employing a roller cleaning system with an increased cleaning capability requiring less maintenance. It is also an object of the invention to provide a particle transfer roller renewal apparatus with an extended useable life.

SUMMARY OF THE INVENTION

In accordance with the invention, there is provided a web surface cleaning apparatus comprising:

- a rotatable particle transfer roller for removing particulate contamination from a web;
- a rotatable renewal roller having a cleaning surface for contacting and cleaning the particle transfer roller;

- means for providing wiping contact between the particle transfer roller and the renewal roller to effect cleaning of the particle transfer roller; and
- means for wetting and cleaning the cleaning surface of the renewal roller.

The invention also provides a method of cleaning particulate contamination from a web, comprising the steps of:

(a) contacting and rotating a particle transfer roller against the web to transfer particles from the web to the particle transfer roller;

(b) disengaging the particle transfer roller from the web;

(c) wetting and cleaning the cleaning surface of a renewal roller with an absorbent cleaning member having a cleaning solution therein;

(d) moving the particle transfer roller into cleaning contact with the wetted cleaning surface of the renewal roller; and (e) rotating the particle transfer roller while locking the renewal roller to effectuate cleaning of the particle transfer roller by the renewal roller.

The invention provides improved particle transfer roller cleaning capability. The cleaning member removes particles from the renewal roller which renews the renewal roller and permits extended use of the renewal roller for cleaning the particle transfer roller. The cleaning effectiveness and useful life of the renewal roller are therefore improved over prior art renewal devices. The web cleaning apparatus of the invention necessitates infrequent shutdowns for maintenance and replacement of the cleaning surface of the renewal roller, which leads to improved cleaning efficiency.

These and other aspects, objects, features and advantages of the present invention will be more clearly understood and appreciated from a review of the following detailed description of the preferred embodiments and appended claims, and by reference to the accompanying drawings.

DESCRIPTION OF THE PREFERRED EMBODIMENTS

Figure 1:
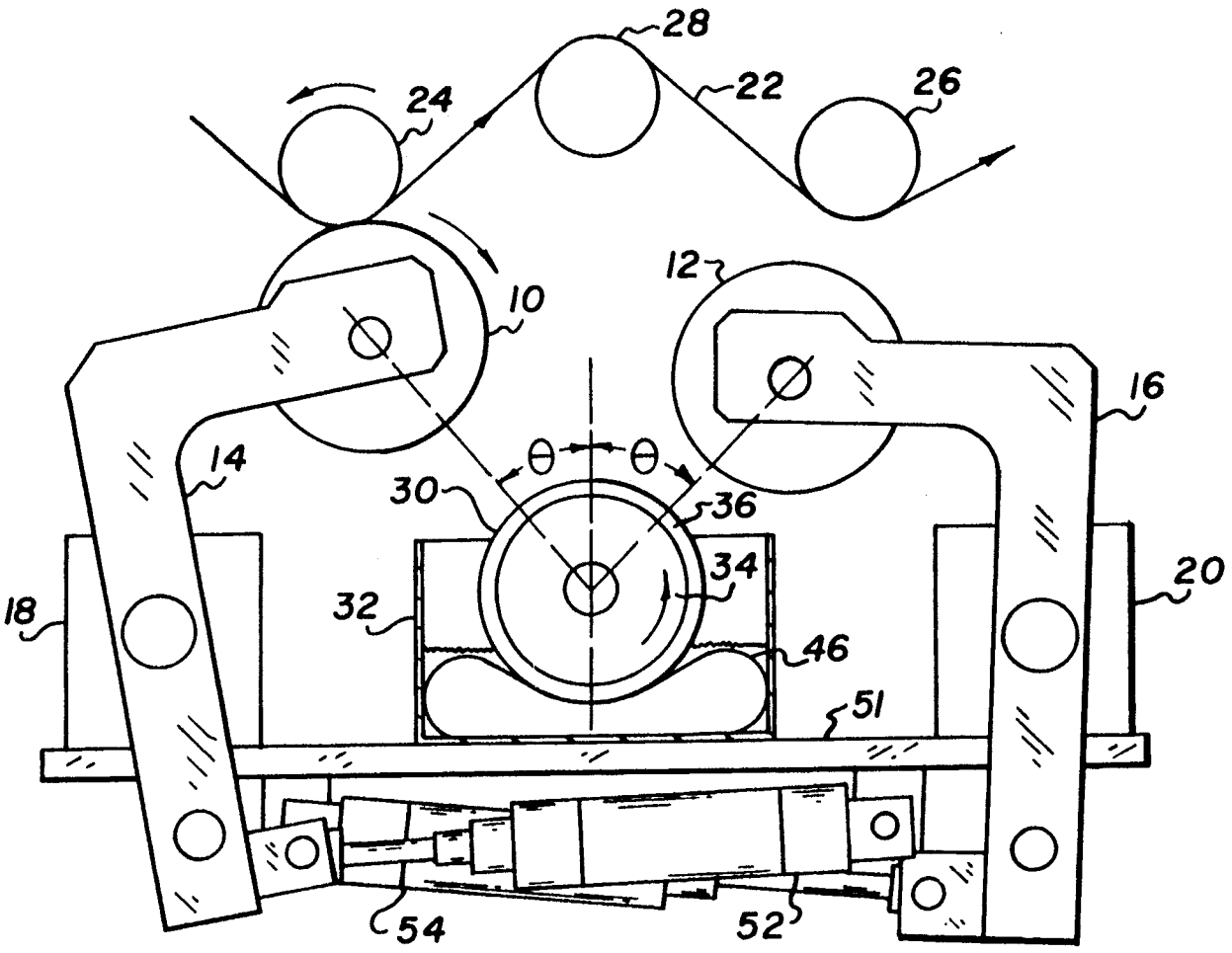
FIG. 1 is an elevation view of an apparatus according to the invention in which two particle transfer rollers are provided to clean one surface of a web. One of the transfer rollers is in the web-cleaning position while the other transfer roller is in a standby position as a renewal member is wetted and cleaned.

FIG. 1 illustrates a web-cleaning system in accordance with the invention. Particle transfer rollers 10 and 12 are rotatably mounted on members 14 and 16, respectively. Members 14 and 16 are pivotally mounted on bases 18 and 20, respectively. As shown, transfer roller 10 is in contact with web 22. A pair of backing rollers, 24 and 26, are provided to provide a nip for web 22 with transfer rollers 10 and 12, respectively, to support web 22 during web-cleaning, described in more detail below. Optional guide roller 28 is provided to maintain an appropriate tension on web 22 between rollers 24 and 26. Transfer rollers 10 and 12 can comprise a soft elastomer material such as polyurethane. One skilled in the art can readily select a useful transfer roller material having a particle coefficient of adhesion greater than that of the web to effect particle transfer from the web to the transfer roller. Transfer rollers 10 and 12 and corresponding backing rollers 24 and 26 are free to rotate as web 22 passes through either nip. Particles on the surface of web 22 adhere to the soft elastomer surface of transfer rollers 10 and 12 to effect the surface cleaning action. As particles build up on transfer rollers 10 and 12, however, their particle pickup or transfer efficiencies decrease, necessitating the cleaning of transfer rollers 10 and 12 to restore their particle transfer effectiveness.

Renewal roller 30 is rotatably mounted and positioned as shown within cleaning fluid reservoir 32. Renewal roller 30 has a resilient foam layer 34 covered by removable, replaceable sleeve 36 which serves as a cleaning surface. Sleeve 36 should be non or low-linting to avoid contaminating transfer rollers 10 and 12. A suitable sleeve material is a cleanroom wiper material comprising 100 percent filament polyester in a woven cloth. A preferred weave is an interlooped warp knit. The warp knit provides sufficient body and unidirectional stretchability for sleeve 36 axially with respect to renewal roller 30, facilitating removal and replacement of sleeve 36 on renewal roller 30, while imparting stiffness to sleeve 36 radially with respect to renewal roller 30 to provide a snug fit thereon and avoid bunching up of sleeve 36 during cleaning of transfer rollers 10 and 12. A useful such sleeve material is Anticon, manufactured by Milliken & Co., Spartanburg, S.C. Sleeve 36 thus provides a surface both to carry the cleaning solution and to scrub and remove particles from transfer rollers 10 and 12, allowing the trapping of the particles within the weave and the solution carried therein.

Figure 2:
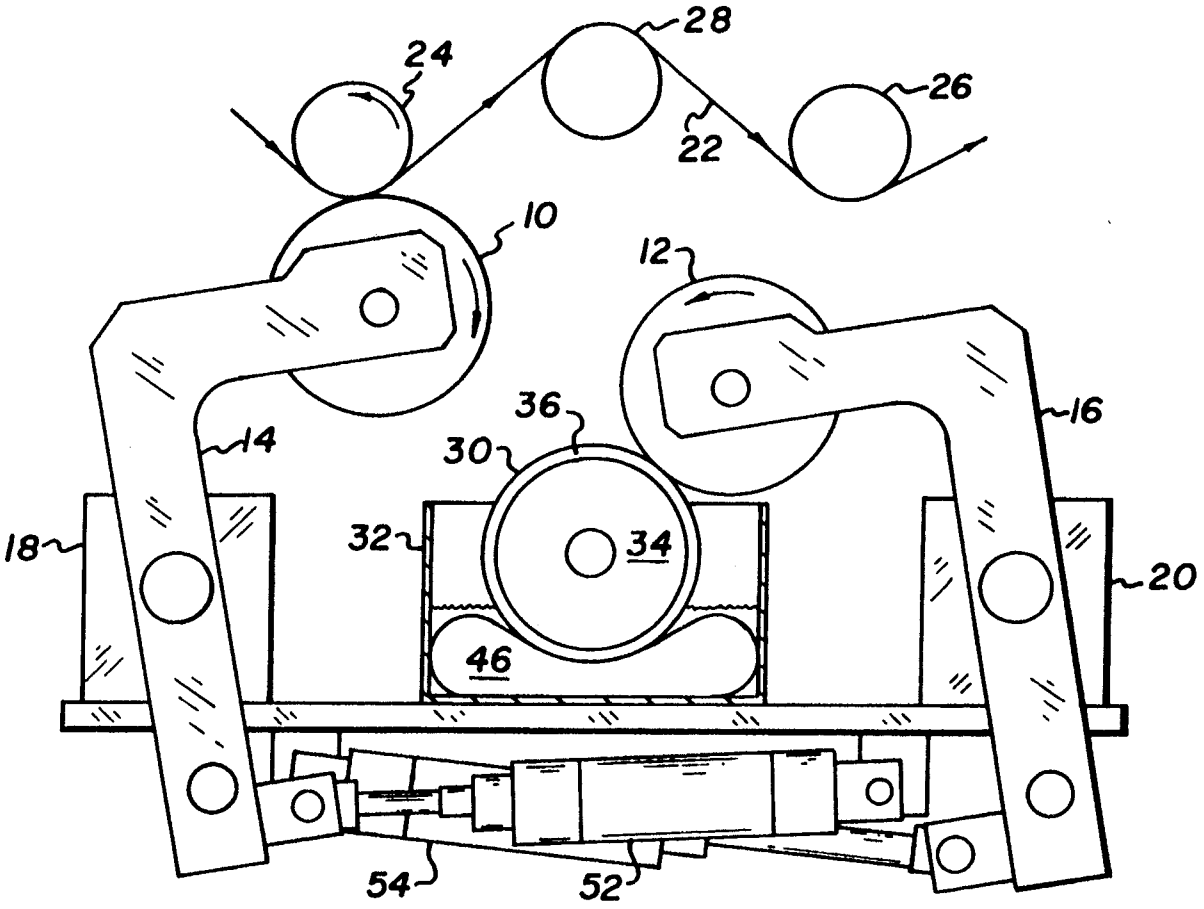
FIG. 2 shows the apparatus of FIG. 1 but with the standby transfer roller now positioned in contact with the renewal member and being renewed, that is, cleaned.
Figure 3:
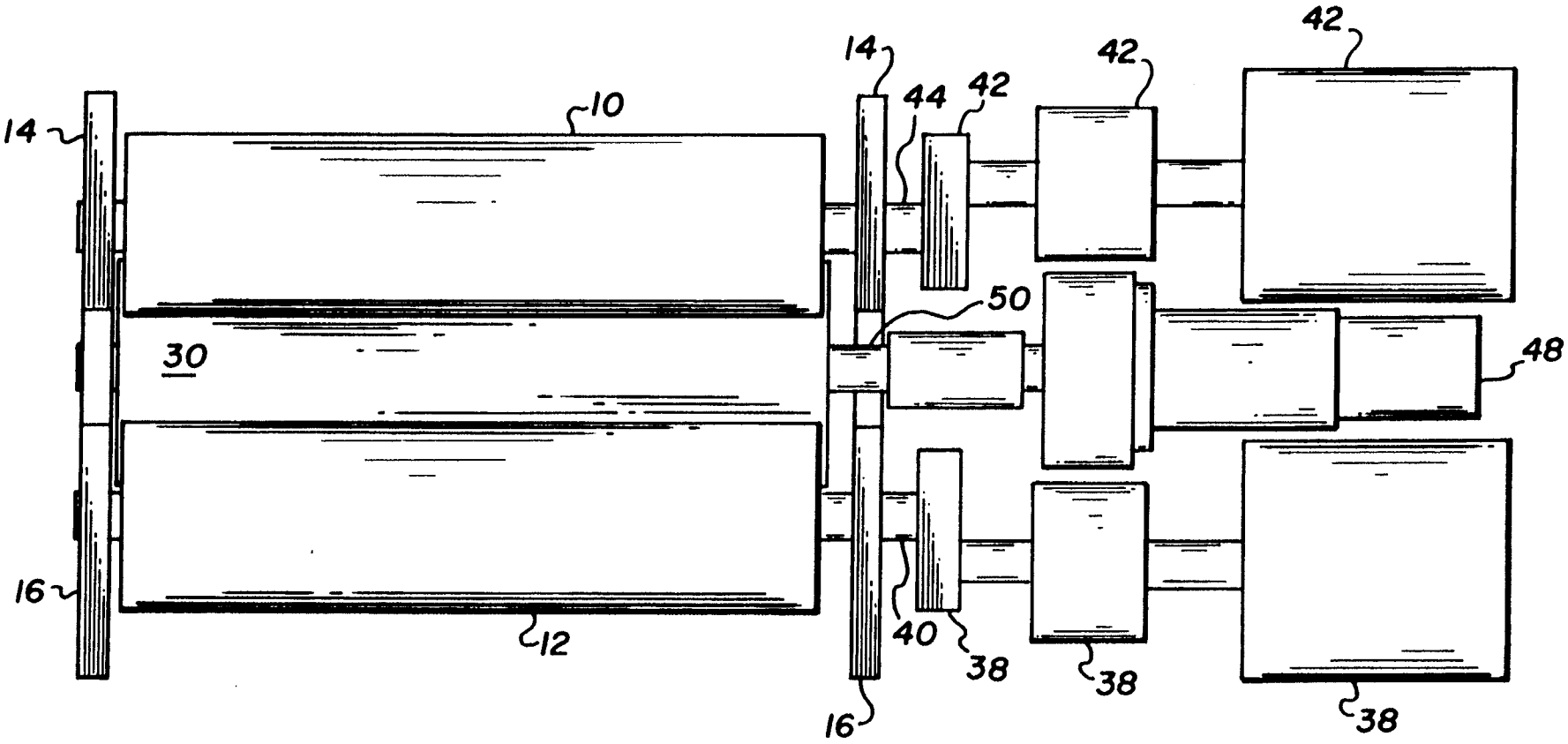
FIG. 3 is a top plan view of the apparatus shown in FIG. 1.

As shown in FIG. 2, transfer roller 12 is in contact with sleeve 36 of renewal roller 30. Referring now to FIG. 3, means for providing wiping contact between transfer roller 12 and sleeve 36 comprises motor and clutch assembly 38 coupled to shaft 40 of transfer roller 12. Assembly 38 is means for rotating transfer roller 12 as transfer roller 12 contacts sleeve 36 to provide wiping action and transfer particulate matter from transfer roller 12 to sleeve 36. Similarly, motor and clutch assembly 42 is coupled to shaft 44 of transfer roller 10 and rotates and operates transfer roller 10 in the same manner.

Means for wetting and cleaning sleeve 36 is absorbent cleaning member 46 positioned in reservoir 32. Cleaning member 46 is preferably flexible and porous and can comprise the same material or type of material as sleeve 36 to minimize introduction of contaminants into the system and facilitate transfer of particles from sleeve 36 to cleaning member 46. Cleaning solution is provided to reservoir 32 and taken up by cleaning member 46. Sufficient cleaning solution should be maintained in reservoir 32 to assure that cleaning member 46 is sufficiently wetted to in turn wet and clean sleeve 36. Automatic level control means (not shown) associated with reservoir 32 and with a cleaning solution supply means (not shown) can be used for this purpose, or, if desired, level maintained manually by the operator. The cleaning solution should be compatible with the particular operating environment and materials. Thus, the solution should not be harmful to the materials selected for the apparatus of the invention or to the web material. For example, when cleaning a polyester or triacetate photographic film support with polyurethane transfer rollers and a polyester sleeve, the cleaning solution can be an 8 percent by volume solution of isopropyl alcohol in deionized water. Means for providing wiping contact between sleeve 36 and cleaning member 46 is stepper motor 48 coupled to shaft 50 of renewal roller 46, which rotates sleeve 36 against cleaning member 46 to thus wet and clean sleeve 36. Stepper motor 48 is also means for locking renewal roller 46 as further described below.

Renewal member 30 can be rotated through an angle sufficient to bring a wetted portion of sleeve 36 into contact with transfer roller 12, and which angle can be selected such that a different such wetted portion of sleeve 36 will contact transfer roller 12 or transfer roller 10 on subsequent cleaning cycles. Transfer rollers 10 and 12 are each shown as offset from the radial centerline of renewal roller 30 normal to base 51 by an angle $\theta$. Assuming about a 10 degree radius of contact between sleeve 36 with either transfer roller, a rotation of renewal roller 30 of 170 degrees should result in a given 10 degree radial section of sleeve 36 in cleaning contact with either transfer roller 10 or 12 about every 18 cleaning cycles, that is, (360 degrees/10 degrees)/2 rollers. A further advantage is that the used section of sleeve 36 is itself wetted and cleaned by cleaning member 46 for the same number of cycles prior to subsequent cleaning contact with a transfer roller. In this manner, the entire cleaning surface of sleeve 36 is effectively utilized and subjected to numerous cleanings, resulting in a more uniform and lower particle loading in sleeve 36, an extended sleeve life, and a better overall cleaning efficiency of the apparatus of the invention.

Means for moving transfer roller 10 and transfer roller 12, respectively, between a web-cleaning position and a renewal position disengaged from web 22 and in contact with renewal roller 30 are pneumatic cylinders 52 and 54, respectively.

The operation of the invention will now be described with reference to FIGS. 1–3, which illustrate transfer roller 10 in the position of cleaning web 22 and transfer roller 12 first in an intermediate, standby position (FIG. 1) and then in a renewal position being cleaned (FIG. 2). Cylinder 52 engages transfer roller 10 with web 22. Web 22 is conveyed through the nip formed with roller 24 in the direction shown. While transfer roller is engaged with web 22, assembly 42 is disengaged from shaft 44, allowing web 22 to rotate both roller 24 and transfer roller 10 in the directions shown and effecting cleaning of web 22 by contact with transfer roller 10. Transfer roller 10 is maintained in contact with web 22 for a selected interval or until it is determined that the particle removal efficiency of transfer roller 10 is lower than desired.

As shown in FIG. 1, while transfer roller 10 is engaged with web 22, transfer roller 12 after its web-cleaning cycle is disengaged from web 22, and preparations for cleaning transfer roller 12 can commence. Stepper motor 48 rotates shaft 50, wiping renewal member 30 against cleaning member 46 and thereby wetting and cleaning sleeve 36. This step can be performed either before, after, or concurrently with the step of disengaging transfer roller 12 from web 22. Renewal roller is rotated about 170 degrees as shown by the direction arrow in FIG.1, after which cylinder 54 positions transfer roller 12 in contact with the wetted, cleaned portion of renewal roller 30 as seen in FIG. 2. Stepper motor 48 locks renewal roller against rotation, and assembly 38 rotates transfer roller 12 in the direction shown in FIG. 2 for a time sufficient to clean transfer roller 12. After cleaning, transfer roller 12 is disengaged from renewal roller 30 again to a standby position as shown in FIG. 1. Transfer roller 12 can remain in the standby position for a time sufficient to allow for drying prior to cleaning contact with web 22. To accelerate drying, drying means such as heat, a doctor blade, or a squeegee blade can be applied to the surface of transfer roller 10. Transfer roller 12 can also be rotated for an additional time while in the standby position to facilitate drying.

Transfer rollers 10 and 12 can each therefore alternate in this manner between web-cleaning and transfer roller cleaning cycles, allowing continuous cleaning of a web with just minimal down-time for servicing the web-cleaning apparatus. If desired, both tranfer rollers 10 and 12 can be renewed at the same time, with renewal roller 30 locked as described. Also, one transfer roller can be employed in combination with the renewal roller/cleaning member of the invention should it not be necessary or desired to have a second transfer roller cleaned and standing by for maintaining a continuous web-cleaning operation. The described web-cleaning apparatus can also be employed for cleaning both sides of a web by routing the web through a reversing roller or other positioning means to expose the opposing web surface to an additional such web-cleaning apparatus. Pluralities of such web-cleaning apparatuses or pairs of apparatuses can be provided as necessary or desired for various web cleaning applications.

The invention is further illustrated by the following examples of its practise.

EXAMPLES 1-17

Tests were run to measure the cleaning effectiveness of an apparatus of the invention. The renewal roller was 6 inches in length and had a 2½ inch diameter aluminum core covered by 3 layers of ⅛ thick foam and an outer sleeve comprising a single layer of Anticon 100. The renewal roller was placed in a reservoir containing a cleaning solution of 8% by volume of isopropyl alcohol in water. The particle transfer roller had a 2½ inch core covered by a ¼ inch thick layer of polyurethane.

For each run, a 5 inch wide web comprising an acetate film base, with various pre-emulsion sub coatings, 5 inches wide, was run repeatedly through numerous rollers to generate particulate on the web. The particle transfer roller was then placed in contact with the web and allowed to freewheel as the web was conveyed over the roller. The PTR was turned by hand, at a rate of roughly 60 RPM, in contact with the renewal roller. A single section of the renewal roller sleeve was used repeatedly for all the tests to determine a relative number of uses per section of the sleeve. The number of revolutions of the PTR on the renewal roller was varied, and the amount of contact ("Contact amount") between the PTR and the renewal roller as measured radially between their respective surfaces was either ¼ inch or ½ inch, which represent, respectively, very light contact with little resistance, and more intimate contact requiring a greater torque on the particle transfer roller.

The particle transfer roller surface was scanned before and after cleaning using a modified Veredus Quality Control System and a particle count obtained for each run. Two particle counts were obtained for each run from two regions of the roller ("Scanning region") which were scanned in relation to the web which was conveyed and cleaned by it: at the slit edge ("Edge"), which was densely loaded; and, towards the center of the web path ("Center"), which was more lightly loaded. All particles from 10 to 100 microns were sized and counted, and the results are shown in Table I, below. All numbers represent total numbers of particles in this range counted together. For each Example 1-17, both center and edge counts were obtained and the results are as shown in Table I. Absolute particle counts between 10 and 100 microns were converted to particles per square centimeter. The last column shows the cleaning efficiency for each set of data.

TABLE I

| Ex. | Scanning region | Number of rotations | Contact amount (cm) | Particles/ $cm^2$ before cleaning | Particles/ $cm^2$ after cleaning | % effic. |
|---|---|---|---|---|---|---|
| 1 | center | 7 | 1.27 | 6348.16 | 550.19 | 91.30 |
| | edge | 7 | 1.27 | 312.68 | 9.09 | 97.10 |
| 2 | center | 7 | 1.27 | 802.54 | 48.41 | 93.90 |
| | edge | 7 | 1.27 | 97.04 | 14.59 | 84.90 |
| 3 | center | 10 | 1.27 | 3363.29 | 43.04 | 98.70 |
| | edge | 10 | 1.27 | 128.54 | 3.38 | 97.30 |
| 4 | center | 10 | 1.27 | 832.35 | 24.74 | 97.00 |
| | edge | 10 | 1.27 | 112.90 | 5.92 | 94.70 |
| 5 | center | 5 | 1.27 | 400.82 | 96.20 | 92.20 |
| | edge | 5 | 1.27 | 56.66 | 7.40 | 86.90 |
| 6 | center | 5 | 1.27 | 2403.80 | 30.38 | 92.70 |
| | edge | 5 | 1.27 | 86.26 | 6.13 | 92.80 |
| 7 | center | 15 | 1.27 | 5020.25 | 458.23 | 90.80 |
| | edge | 15 | 1.27 | 292.18 | 5.92 | 97.90 |
| 8 | center | 15 | 1.27 | 8150.88 | 40.35 | 99.50 |
| | edge | 15 | 1.27 | 99.37 | 5.50 | 93.90 |
| 9 | center | 10 | 0.64 | 90.49 | 29.81 | 67.00 |
| | edge | 10 | 0.64 | 1481.65 | 72.15 | 95.10 |
| 10 | center | 10 | 0.64 | 108.67 | 8.25 | 92.40 |
| | edge | 10 | 0.64 | 1234.25 | 45.88 | 96.20 |
| 11 | center | 10 | 0.64 | 87.10 | 9.94 | 88.50 |
| | edge | 10 | 0.64 | 717.55 | 89.22 | 87.50 |
| 12 | center | 20 | 0.64 | 10.99 | 1.90 | 82.60 |
| | edge | 20 | 0.64 | 1465.82 | 56.33 | 96.10 |
| 13 | center | 20 | 0.64 | 55.60 | 2.96 | 94.60 |
| | edge | 20 | 0.64 | 4191.14 | 105.06 | 97.40 |
| 14 | center | 20 | 0.64 | 69.98 | 11.42 | 83.60 |
| | edge | 20 | 0.64 | 4536.71 | 437.97 | 90.30 |
| 15 | center | 30 | 0.64 | 265.75 | 2.75 | 98.90 |
| | edge | 30 | 0.64 | 4133.42 | 19.06 | 99.50 |
| 16 | center | 30 | 0.64 | 2134.69 | 7.62 | 99.50 |
| | edge | 30 | 0.64 | 4020.33 | 44.47 | 98.90 |
| 17 | center | 30 | 0.64 | 254.55 | 11.42 | 95.50 |
| | edge | 30 | 0.64 | 6346.89 | 409.15 | 93.50 |

The results show that the 1.27 cm contact yielded better results for the same number of rotations. The results also show that 10 to 15 rotations were adequate for removing about 95% of the particles off the PTR, which translates to 10 to 15 seconds of renewal process time in the test runs of Examples 1-17. The 0.64 cm contact results show that about 30 rotations were needed to obtain similar cleaning results to the 1.27 cm contact runs. Over the duration of the test, in which the same area of the cleaning sleeve was used 20 times, there was no apparent loss of cleaning efficiency, nor was there any apparent physical damage to the sleeve. Contact between the used area of the sleeve and the reservoir material caused some of the particles to transfer down onto the anticon material covering the sponge reservoir.

The invention is useful in any application requiring cleaning of a web. For example, it is useful in photographic film cleaning applications, such as the cleaning of exposed film in movie projection or in the manufacturing of all types of photographic film.

The invention has been described in detail with particular reference to a preferred embodiment thereof, but it will be understood that variations and modifications can be effected within the spirit and scope of the invention.

We claim:

1. A web surface cleaning apparatus, comprising:
a rotatable particle transfer roller for removing particulate contamination from a web;
a rotatable renewal roller having a cleaning surface for contacting and cleaning the particle transfer roller;
means for providing wiping contact between the particle transfer roller and the renewal roller to effect cleaning of the particle transfer roller, said wiping means comprising means for moving the particle transfer roller between a cleaning position in contact with the web and a renewal position disengaged from the web and in contact with the renewal roller; and
means for wetting and cleaning the cleaning surface of the renewal roller.

2. The cleaning apparatus of claim 1, wherein the means for wetting and cleaning comprises:
a cleaning fluid reservoir;
an absorbent cleaning member positioned in the cleaning fluid reservoir; and
means for providing cleaning contact between the cleaning surface of the renewal roller and the wettable surface of the cleaning member, said means comprising means for rotating the renewal roller with the cleaning surface of the renewal roller in contact with the cleaning member to effectuate wetting and cleaning of the cleaning surface of the renewal roller.

3. The cleaning apparatus of claim 1, wherein the cleaning surface of the renewal roller is a replaceable sleeve positioned on a resilient core.

4. The cleaning apparatus recited in claim 1 wherein the wiping means further comprises means for rotating the particle transfer roller while in contact with the renewal roller; and means for locking the renewal roller against rotation during the wiping contact with the transfer roller.

5. A web surface cleaning apparatus comprising:
a pair of rotatable particle transfer rollers for removing particulate contamination from the surface of a web;
a renewal roller having a cleaning surface for contacting and cleaning the particle transfer rollers;
means for providing wiping contact between the particle transfer rollers and the renewal roller to effect cleaning of the particle transfer roller;
a cleaning fluid reservoir;
an absorbent cleaning member positioned in the cleaning fluid reservoir;
means for moving each particle transfer roller between a cleaning position in contact with the web and a renewal position disengaged from the web and in contact with the renewal roller;
means for providing wiping contact between the cleaning surface of the renewal roller and the cleaning member to effectuate wetting and cleaning of the cleaning surface of the renewal roller; and,
means for locking the renewal roller against rotation during the wiping contact with a particle transfer roller.

6. The cleaning apparatus of claim 5, wherein the cleaning surface of the renewal roller is a replaceable sleeve positioned on a resilient core.

7. The cleaning apparatus of claim 5, wherein the means for providing wiping contact between the cleaning surface of the renewal roller and the cleaning member comprises means for rotating the renewal roller with the cleaning surface of the renewal roller in contact with the cleaning member.

8. An apparatus for cleaning a particle transfer roller, comprising:
a rotatable renewal roller having a cleaning surface for contacting and cleaning the particle transfer roller;
means for moving the particle transfer roller between a cleaning position in contact with the web and a renewal position disengaged from the web and in contact with the renewal roller;
means for providing wiping contact between the particle transfer roller and the renewal roller to effect cleaning of the particle transfer roller, said means comprising means for moving the particle transfer roller between a cleaning position in contact with the web and a renewal position disengaged from the web and in contact with the renewal roller; means for rotating the particle transfer roller while in contact with the renewal roller; and means for locking the renewal roller against rotation during the wiping contact with the particle transfer roller; and,
means for wetting and cleaning the cleaning surface of the renewal roller.

9. The cleaning apparatus of claim 8, wherein the means for wetting and cleaning comprises:
a cleaning fluid reservoir;
an absorbent cleaning member positioned in the cleaning fluid reservoir; and
means for providing wiping contact between the cleaning surface of the renewal roller and the wettable surface of the cleaning member to effectuate wetting and cleaning of the cleaning surface of the renewal roller.

10. The cleaning apparatus of claim 8, wherein the cleaning surface of the renewal roller is a replaceable sleeve positioned on a resilient core.

* * * * *